US005318492A

United States Patent [19]

Quinn

[11] Patent Number: 5,318,492

[45] Date of Patent: Jun. 7, 1994

[54] JOGGING WEIGHT WITH REPELLENT CHEMICAL

[76] Inventor: Joan M. Quinn, 1718 Big Horn, Houston, Tex. 77090

[21] Appl. No.: 13,938

[22] Filed: Feb. 5, 1993

[51] Int. Cl.[5] ..... A63B 21/072

[52] U.S. Cl. ..... 482/108; 482/106; 482/50; 273/84 R; 42/1.08

[58] Field of Search ..... 482/50, 74, 92, 106, 482/108, 109; 273/84 R, 84 ES; 42/1.08, 1.13, 1.16

[56] References Cited

U.S. PATENT DOCUMENTS

| | | | |
|---|---|---|---|
| D. 297,961 | 10/1988 | Egger | D21/197 |
| 3,385,601 | 5/1968 | Black | 273/84 R |
| 4,463,879 | 8/1984 | Des Voignes . | |
| 4,477,005 | 10/1984 | Martinez . | |
| 4,504,980 | 3/1985 | Butcher . | |
| 4,512,587 | 4/1985 | Burke et al. | 222/504 |
| 4,702,473 | 10/1987 | Paquette | 482/74 |
| 5,033,740 | 7/1991 | Schwartz et al. . | |
| 5,086,377 | 2/1992 | Roberts | 273/84 R |
| 5,088,121 | 2/1992 | Wallace . | |
| 5,135,455 | 8/1992 | King et al. . | |
| 5,242,349 | 9/1993 | Reiff et al. | 482/108 |

FOREIGN PATENT DOCUMENTS 21900 of 1903 United Kingdom .

OTHER PUBLICATIONS

Abercrombie & Fitch advertisement, Washington Post Feb. 17, 1983.

*Primary Examiner*—Richard J. Apley
*Assistant Examiner*—Jeanne M. Mollo
*Attorney, Agent, or Firm*—Harrison & Egbert

[57] ABSTRACT

A jogging weight having a body with a handle portion formed therein and a chamber formed in the handle portion of the body. The handle portion is suitable for the receipt of a human hand. The chamber has a generally cylindrical configuration. The chamber opens along a top surface of the body. The body has a trumpet area formed along a top portion of the body. This trumpet area extends generally transverse to the chamber. The trumpet area opens adjacent to an opening of the chamber and has a flared opening opposite the chamber. A canister of a repellent chemical is removably affixed within the chamber. The canister has a nozzle extending outwardly of the chamber so as to deliver a spray of repellent chemical through the trumpet area. An elastomeric member is interposed between the canister and the chamber so as to retain the canister within the chamber.

16 Claims, 3 Drawing Sheets

JOGGING WEIGHT WITH REPELLENT CHEMICAL

TECHNICAL FIELD

The present invention relates to jogging weights. More particularly, the present invention relates to jogging weights that include suitable self-defense sprays incorporated therein.

BACKGROUND ART

Jogging is a favorite exercise for millions of Americans. Typically, the jogger will cover large distances during his or her jogging activity. In many cities, such long distances will cause the jogger to pass through dangerous, or at least unsavory, neighborhoods. Many times, the jogger must pass through residential areas that have numerous dogs wandering about. Over the years, there has developed the need to provide the jogger with a means for self-defense during his or her jogging activity.

In recent years, a jogging device has been developed known as "Heavyhands". The "Heavyhands" strength endurance exercise system, described in the books "Heavyhands Walking" and "The Heavyhands Walking Book!", both by Leonard Schwartz, utilizes a weight that is held in an exerciser's hand. The weight has a strap that fits across the back of the hand and facilitates the exerciser holding the hand weight while the exerciser moves his or her arm in a prescribed fashion. Ideally, the strap only provides support which aids the exerciser in holding the hand weight but does not constrict the hand and thereby hinder blood flow through the hand. The "Heavyhands" system is a system of high repetition movements that involves heart, lungs, and every muscle group simultaneously. The "Heavyhands" system can be adapted so as to receive heavier weights by simply screwing the weights onto the ends of the handle. The "Heavyhands" can be employed during walking, jogging, dancing, bending and twisting activities. It has been found that three or four half hour workouts per week superbly condition the cardiopulmonary system and over ninety percent of the body muscle. The "Heavyhands" system burns calories and fat at enormous rates. In normal use, the "Heavyhands" system is employed by a large number of joggers during jogging activities. Unfortunately, the "Heavyhands" system is of minimal self-defense value. There has developed the need to enhance the ability to use the "Heavyhands" system during jogging exercise while still facilitating the ability to carry out self-defense, if necessary.

In the past, a large number of patents have issued that describe various hand held gas dispensers. U.S. Pat. No. 5,088,121, issued on Feb. 18, 1992, to J. E. Wallace shows a glove or mitten having a pocket in the palm thereof so as to hold the container of a chemical repellent, such as mace. The pocket can be attached to the hand by way of a glove or by way of a strap extending around the periphery of the palm.

U.S. Pat. No. 4,477,005, issued on Oct. 16, 1984, to L. Martinez teaches a portable hand-mounted defense weapon system. This device utilizes a strap having VELCRO (TM) fasteners so as to allow the strap to be extended around the palm of the hand. A pocket is formed in the strap for receiving the mace canister.

U.S. Pat. No. 4,504,980, issued on Mar. 19, 1985, to D. M. Butcher, shows a security hand band which is formed of a strip of bright colored, waterproof cloth. The strip has a first opening adjacent one end so as to receive the user's thumb. Openings are provided so as to accommodate various sizes of hands. A VELCRO (TM) material is used in the palm of the hand of the user so as to receive a canister of mace. The strip also has reflectors on its end so as to reflect light at night.

U.S. Pat. No. 4,463,879, issued on Aug. 7, 1984, to G. C. Des Voignes teaches another type of attack repellent holder. This device includes an elastic strap that secures the repellent to the hand. The repellent is positioned adjacent to the thumb of the hand so that the actuator for the repellent canister is positioned adjacent to the thumb or fingers of the user.

Various jogging weights have been developed in the past so as to carry out the "Heavyhands" system. U.S. Pat. No. 5,033,740, issued on Jul. 23, 1991, to Schwartz et al. shows the hand weight as having a bolted arrangement on the ends of the handle so as to receive internally threaded weights. British Patent No. 21900, issued in 1903, shows an early embodiment of a jogging weight. U.S. Pat. No. 5,135,455, issued on Aug. 4, 1992. to King et al. describes a user-friendly dumbbell which includes a weight which is covered with a protective material.

Unfortunately, none of these prior art patents describes a "Heavyhands" system that includes the use of a repellent chemical. The prior art patents, that describe the use of gloves with attachments for the receipt of repellent chemicals, do not provide the weight of the "Heavyhands" system. As such, such configurations are not particularly useful for jogging purposes. The embodiments of weights which can be used in the "Heavyhands" system are useful for the jogging activities, but do not incorporate a means of self-defense, such as a chemical repellent spray. As such, a need has developed for the incorporation of a self-defense chemical system in a jogging weight.

It is an object of the present invention to provide a jogging weight that includes a means for the receipt of a self-defense chemical spray.

It is another object of the present invention to provide a jogging weight that enhances the quality of exercise of the jogger.

It is another object of the present invention to provide a jogging weight that includes a self-defense chemical spray that is conveniently positioned for use by the jogger.

It is still a further object of the present invention to provide a jogging weight that includes a self-defense chemical which is easy to use, easy to manufacture, relatively inexpensive and aesthetically pleasing.

These and other objects and advantages of the present invention will become apparent from a reading of the attached specification and appended claims.

SUMMARY OF THE INVENTION

The present invention is a jogging weight that comprises a body having a handle portion formed therein and a chamber formed in the handle portion of the body. The handle portion is suitable for receipt of a human hand. The chamber has a generally cylindrical configuration. This chamber opens along a top surface of the body. The chamber includes means therein for the removable receipt of a canister of a repellent chemical.

The body has a weight of between two and ten pounds. The body includes a trumpet area which is formed along a top portion of the body. This trumpet area extends generally transverse to the chamber. The trumpet area opens generally adjacent to the opening of the chamber. The trumpet area has a generally cylindrical configuration in the body. The cylindrical configuration includes a flared opening opposite the chamber. The handle portion has a generally circular configuration. This handle portion has a forward section and a rearward section. The chamber is formed in the rearward section of the handle portion. The flared opening of the trumpet area is in the forward section of the handle.

A canister of a repellent chemical, such as mace, is removably affixed within the chamber. The canister has a nozzle that extends outwardly of the chamber. This canister is for delivering a spray of the repellent chemical outwardly of the body. An elastomeric member extends around the canister so as to be interposed between the chamber and the cannister. Specifically, the elastomeric member is an O-ring which is removably affixed around the cannister. Both the canister and the chamber have a generally cylindrical configuration. The nozzle of the canister is positioned adjacent to the trumpet area. The nozzle serves t o deliver the spray of repellent chemical outwardly through the trumpet area.

DETAILED DESCRIPTION OF THE INVENTION

Figure 1:
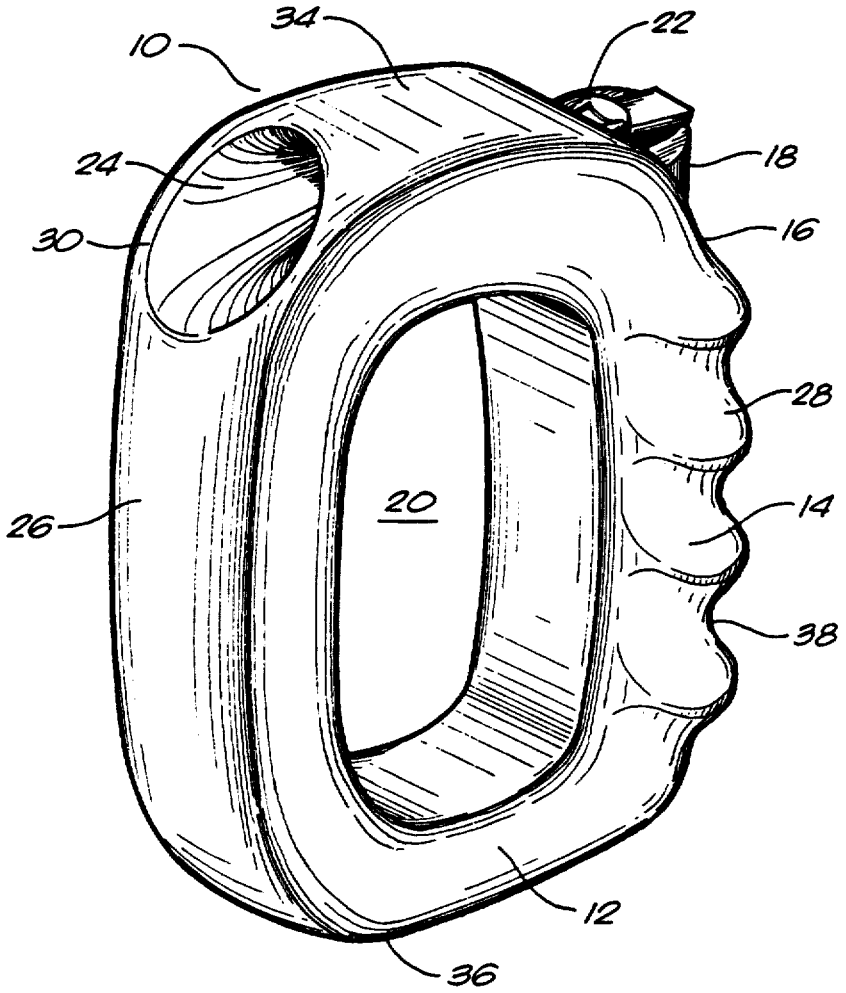
FIG. 1 is a perspective view of the jogging weight in accordance with the preferred embodiment of the present invention.

Referring to FIG. 1, there is shown at 10 the jogging weight in accordance with the preferred embodiment of the present invention. As can be seen, the jogging weight 10 includes the body portion 12 having a handle 14 formed therein. A chamber 16 is formed in the handle portion 14 of the body 12. The chamber 16 is suitable for the receipt of a canister 18 of a repellent chemical. The handle portion 14 has an opening 20 which has an area suitable for the receipt of a portion of a human hand. The canister 18 is removably affixed within the chamber 16 of the body 12. The canister 18 includes a nozzle 22 which extends outwardly of the body 12. The nozzle 22 is suitable for delivering a spray of the repellent chemical outwardly of the body through the trumpet area 24.

As can be seen, the body 12 is formed of a molded plastic material. Typically, the body 12 will have a substantial weight of between two and ten pounds. It has been found that the use of a weight of between two and ten pounds is most effective for enhancing the exercise value during jogging activity. Such a weight can be formed by molding plastic material or by forming leaded material surrounded by a plastic coating. In keeping with the present invention, the body 12 should be suitably formed so as to be weighted to the requirements of the jogger.

The body 12 has a generally circular or oval configuration. The body 12 includes a forward portion 26 and a rearward portion 28. In normal use, the forward portion 26 will extend outwardly of the hand over the back surfaces of the fingers of the user. The forward portion 26 includes a flat outer surface. The opening of the trumpet area 24 occurs on this forward portion 26. It can be seen that the trumpet area 24 includes a flared end 30 which opens to the outer surface of the forward section 26. In normal use, the flared end 30 of the trumpet area 24 will allow the spray from the nozzle 20 of canister 18 to pass outwardly therefrom. The trumpet area 24 is suitable for allowing the spray to be properly directed forward of the user of the jogging weight 10.

The body 12 also includes a top surface 34 and a bottom surface 36. The top surface 34 will extend over the top of the forefinger of the user. Similarly, the bottom surface 36 will extend over the bottom of the small finger of the user. The rearward portion 28 of body 12 includes a gripping surface 38 which conforms to the hand of the user. The gripping surface 38 is particularly useful for allowing the jogging weight 10 to be comfortably received within the hand cf the user. The hand will extend through the area 20 formed on the interior of the body 12.

By surrounding the hand of the user, the jogging weight 10 further and unexpectedly enhances the self-defense value of the device. In addition to the inclusion of the self-defense chemical spray canister 18, the jogging weight 10 is also conformed so as to serve as a self-defense weapon in itself. The forward surface 26 and the gripping surface 38 of the body 12 enhances the ability of the user to use the jogging weight 10 as a blunt instrument for the purpose of fending off attackers. This configuration, in combination with the use of the self-defense chemical, will allow the jogger to hit the attacker while the attacker is immobilized from the spray. Alternatively, the weight can be used to strike the attacker and the spray can be used when the attacker is stunned. As such, the jogging weight 10 of the present invention provides an unexpected benefit to the user.

The body 12 can be molded of a hard plastic material. Additionally, the body 12 should be made of a bright colored or reflective material. The color of the body 12 enhances the visibility of the jogger to automobiles and other passers-by. Additionally, as can be seen, the canister 18 is clearly visible on the jogging weight 10. This serves as discouragement to would-be attackers. It can be seen that the nozzle 22 of the canister 18 extends clearly above the top of the chamber 16 formed on the rearward portion 28 of body 12.

Figure 2:
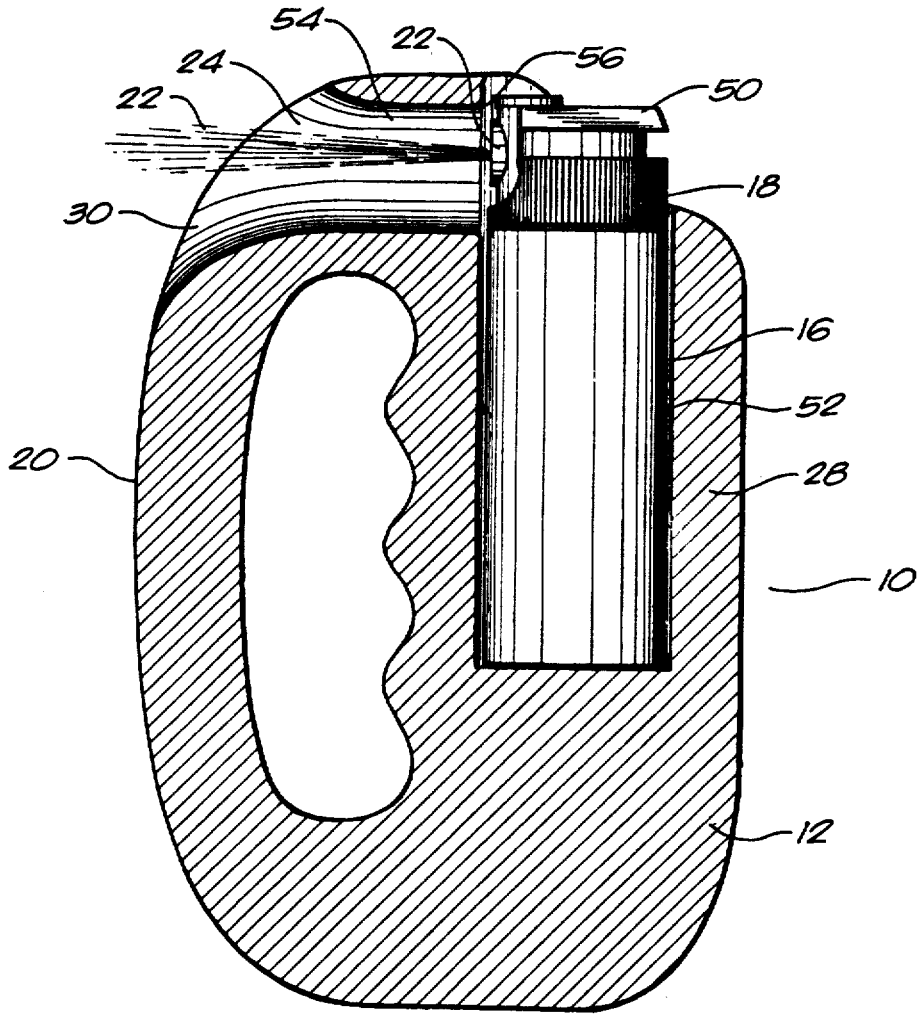
FIG. 2 is a cross-sectional view of the jogging weight of the present invention.

FIG. 2 shows a cross-sectional view of the jogging weight 10 of the present invention. As can be seen, the jogging weight 10 includes the body portion 12 and the chamber 16 formed therein. The chamber 16 has a cylindrical configuration that extends downwardly into the body 12. It can be seen that the chamber 16 has a depth which is less than the length (or height) of the canister 18. The sizing of the chamber 16 is important so that the canister 18 can be properly positioned such that the nozzle 22 is directed toward the trumpet area 24. A button 50 is provided on the top of canister 18 so as to allow the user of the jogging weight 10 to be easily activate the spray such that the repellent chemical passes through the nozzle 22. The button 50 is positioned adjacent the rearward portion 28 of the body 12. As such, the button 50 is positioned in a convenient location for use by the thumb of the jogger.

It can be seen that the canister 18 has a generally cylindrical configuration of a smaller diameter than that of the chamber 16. In normal use, the canister 18 will be slidably received within the interior of the chamber 16. However, because of the dimensional difference between the diameter of the canister 18 and the interior diameter of the chamber 16, it is necessary to secure the canister 18 within the chamber 16. This task is accomplished by the use of an elastomeric member 52 that extends around the diameter of the canister 18. The elastomeric member 52 is an O-ring which can be fitted on the exterior surface of the canister 18. As can be seen, this elastomeric member 52 is interposed between the inner diameter of chamber 16 and the outer diameter of the canister 18. As such, the canister 18 is securely and removably affixed within the interior of chamber 16.

It can be seen that the trumpet area 24 includes a cylindrical portion 54 that has an end 56 opening adjacent to the nozzle 22 of canister 18. The other end of the trumpet area 24 is flared so as to open on the outer surface of the forward portion 20 of body 12. The trumpet area 24 allows the spray from the canister 18 to pass outwardly from the body 12 in a desired direction. For example, if the jogger is attacked, the trumpet area 24, along with the jogging weight 10, are directed toward the attacker. By depressing the button 50, a repellent spray 22 is released so as to pass through the opening 56 of the trumpet area 24. The spray will then pass out of the flared opening 30 at the would-be attacker.

In normal use, the canister 18 will contain a repellent chemical, such as mace. However, depending upon the requirements of the user, the chamber 16 is also suitable for receiving other types of repellant sprays. Other sprays may include dog and insect repellents. If the risk of attack by dogs is great, then the jogger can simply insert a canister of dog repellent into the chamber 16. The hard texture of the jogging weight 10, and its considerable weight, can further be used to deter the attacking dog.

Figure 3:
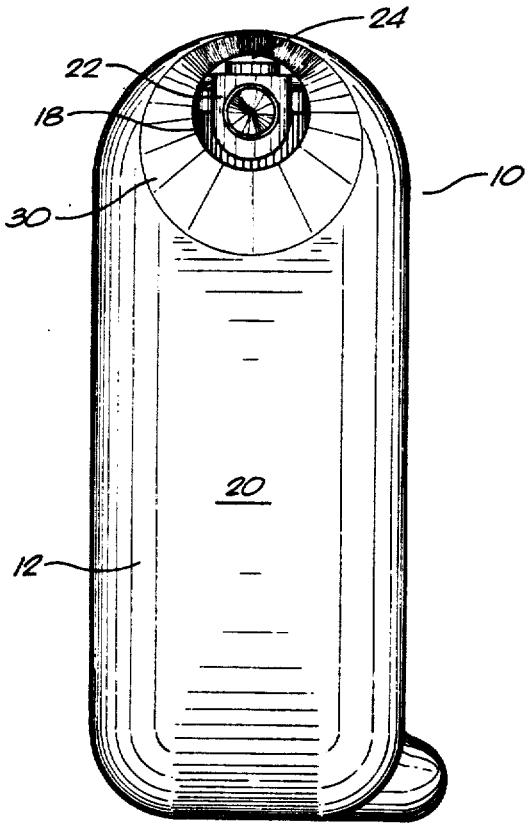
FIG. 3 is a frontal view of the jogging weight of the present invention.

FIG. 3 shows a frontal view of the jogging weight 10 of the present invention. As can be seen, the body 12 is shown at its forward surface 20. The flared opening 30 of the trumpet area 24 is illustrated as directed toward the viewer of FIG. 3. The canister 18 is positioned such that the nozzle 22 is directed outwardly. The configuration of the trumpet area 24 is suitable for "funneling" the spray toward the would-be attacker.

Figure 4:
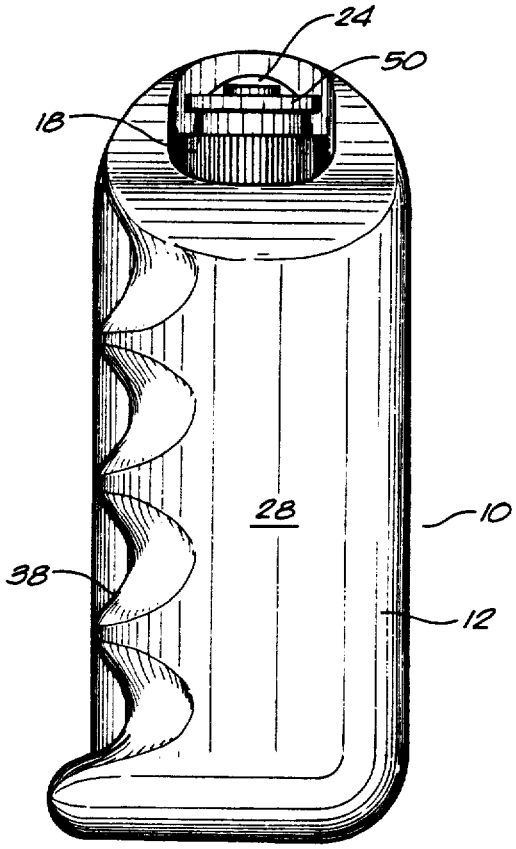
FIG. 4 is a rear view of the jogging weight of the present invention.

FIG. 4 shows the rearward view of the body 12 of jogging weight 10. Specifically, the rearward portion 28 is illustrated in FIG. 4. The view of FIG. 4 will be the view that the user of the jogging weight 10 sees during jogging activities. Specifically, the jogger will wrap his or her hand around the rearward surface 24 and through the opening of the handle portion 14. The thumb of the jogger may be placed on the lever 50 of canister 18. As can be seen, the trumpet area 24 opens toward the rearward surface 28 and also opens through the forward surface 20. The gripping surface 38 is provided so as to increase the stability of the jogging weight 10 when in the hands of the user.

Under attack conditions, the jogger can simply place his or her thumb on the button 50 of canister 18. By depressing the button, the spray will pass through the trumpet area 24 and outwardly of the jogging weight 10.

The present invention is essentially a mace-loaded set of jogging/running weights that are held in each hand. These weights are molded comfortably to the shape of the hand and palms. The thumb is used to activate a powerful spray of mace or dog repellent when the jogger/runner is confronted with a hostile person or dog. The jogging weight is comprised of an empty chamber within the core cylinder. The mace capsule or canister is inserted and secured for use. If the mace or repellent is utilized for defensive purposes, then the chamber is emptied and a new mace capsule is inserted. The weight of the jogging weight 10 can be adapted so that it can be of a fixed weight or can include suitable bolts or other configurations so that different weights can be received. The trigger (or button 50) is conveniently located under the thumb resting spot. This trigger can be pressed so as to activate the repellent or mace for ejection. The jogging weight 10 can be painted in a reflective or neon color for night-time identification and for other safety purposes.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A hand weight comprising:

a body having a handle portion, said handle portion having an opening with an area suitable for the receipt of a portion of a human hand, said body having a chamber formed interior of said handle portion, said chamber opening to a surface of said body, said body having a trumpet area extending generally transverse to said chamber; and a canister containing a repellent chemical removably affixed within said chamber of said body, said canister having a nozzle extending outwardly above a top surface of said body for direct access by a user, said canister for delivering a spray of said repellent chemical outwardly of said body, said trumpet area positioned adjacent to said nozzle of said canister so that said repellent chemical is directed through said trumpet area.

2. The jogging weight of claim 1, said body having a weight of not less than two pounds.

3. The jogging weight of claim 1, said chamber having a generally cylindrical configuration, said canister slidably received within said chamber.

4. The jogging weight of claim 3, said chamber having a depth less than a height of said canister.

5. The jogging weight of claim 1, said trumpet area having a generally cylindrical configuration in said body, said cylindrical configuration having a flared opening opposite said nozzle.

6. The jogging weight of claim 1, said body being of a molded plastic material.

7. The jogging weight of claim 1, said opening of said handle portion having a generally oval configuration, said body extending around said oval configuration.

8. The jogging weight of claim 3, said canister having an elastomeric member extending therearound, said elastomeric member interposed between said canister and said chamber.

9. The jogging weight of claim 1, said repellent chemical being mace.

10. A hand weight comprising:

a body having a handle portion formed therein, said handle portion suitable for the receipt of a human hand; and a chamber formed in said handle portion of said body, said chamber having a generally cylindrical configuration, said chamber opening along a top surface of said body, said chamber having means therein for removable receipt of a canister of a repellent chemical, said body having a trumpet area extending generally transverse of said chamber; and a canister of a repellent chemical removably affixed within said chamber, said canister having a nozzle extending outwardly above a top surface of said chamber for direct access by a user, said canister for delivering a spray of said repellent chemical outwardly of said body, said trumpet area positioned adjacent to said nozzle, said nozzle for directing said repellent chemical through said trumpet area.

11. The jogging weight of claim 10, said body having a weight of between two and ten pounds.

12. The jogging weight of claim 10, said trumpet area having a generally cylindrical configuration in said body, said cylindrical configuration having a flared opening opposite said chamber.

13. The jogging weight of claim 12, said handle portion having a generally circular configuration, said handle portion having a forward section and a rearward section, said chamber formed in said rearward portion, said flared opening of said trumpet area being at said forward section.

14. The jogging weight of claim 10, said means being an elastomeric member extending around said canister so as to be interposed between said canister and said chamber.

15. The jogging weight of claim 14, said elastomeric member being an O-ring removably affixed around said canister, said canister being of a cylindrical configuration.

16. The jogging weight of claim 10, said repellent chemical being mace, said body being of a molded plastic material.

* * * * *